US011369853B1

(12) United States Patent
Tarlini

(10) Patent No.: US 11,369,853 B1
(45) Date of Patent: Jun. 28, 2022

(54) FOOTBALL TRAINING DEVICE

(71) Applicant: Jacob Tarlini, Philadelphia, PA (US)

(72) Inventor: Jacob Tarlini, Philadelphia, PA (US)

( * ) Notice: Subject to any disclaimer, the term of this patent is extended or adjusted under 35 U.S.C. 154(b) by 20 days.

(21) Appl. No.: 16/940,447

(22) Filed: Jul. 28, 2020

(51) Int. Cl.
*A63B 69/34* (2006.01)

(52) U.S. Cl.
CPC ..... *A63B 69/345* (2013.01); *A63B 2225/093* (2013.01); *A63B 2243/007* (2013.01)

(58) Field of Classification Search
CPC . A63B 69/34; A63B 2225/093; A63B 63/004; A63B 69/345; A63B 2243/007
USPC ..... 473/422, 446, 441, 438; 482/83
See application file for complete search history.

(56) References Cited

U.S. PATENT DOCUMENTS 4,564,192 A * 1/1986 Lebowitz ..... A63B 69/004 446/334
4,749,184 A * 6/1988 Tobin ..... A63B 69/0091 482/129
5,352,170 A * 10/1994 Condo ..... A63B 69/201 482/83
6,077,204 A * 6/2000 Dickinson, Jr. ..... A63B 69/004 269/131
6,302,831 B1 10/2001 Henry
6,663,512 B2 * 12/2003 Martin ..... A63B 24/0021 473/452
6,896,630 B1 * 5/2005 Breining ..... A63B 69/36211 473/422
7,086,997 B1 * 8/2006 Fields ..... A63B 69/004 482/83
7,806,787 B1 * 10/2010 Gamboa ..... A63B 69/345 473/438
8,602,944 B2 12/2013 Fleitz
8,834,325 B2 9/2014 Chen
9,039,584 B2 5/2015 Chiang
9,295,892 B2 3/2016 Harrigan
10,569,151 B2 2/2020 Hall
10,639,535 B2 * 5/2020 Hoover ..... A63B 69/20
2006/0025284 A1 * 2/2006 Livingstone ..... A63B 69/24 482/83
2006/0058158 A1 * 3/2006 McAvoy ..... A63B 21/4047 482/38
2007/0167297 A1 * 7/2007 Stevenson ..... A63B 69/004 482/83
2008/0254950 A1 10/2008 Beliles
2018/0021650 A1 * 1/2018 Hoover ..... A63B 69/20 482/83
2019/0143189 A1 5/2019 Elmore
2020/0038731 A1 2/2020 Diaz

* cited by examiner

*Primary Examiner* — Mitra Aryanpour
(74) *Attorney, Agent, or Firm* — Kyle A. Fletcher, Esq.

(57) ABSTRACT

The football training device is a physical training apparatus. The football training device is configured for use with the sport of American football. The football training device trains an individual in the motions associated with a swim move. The football training device further trains an individual in the motions associated with a rip move. The football training device incorporates a stand and a training structure. The training structure attaches to the stand. The training structure further incorporates a plurality of cants. The plurality of cants form a series of spatial relationships between the components of the training structure. The plurality of cants emulate the position and motion of an opponent during training activities.

17 Claims, 5 Drawing Sheets

FOOTBALL TRAINING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports and apparatus for physical training, more specifically, a sports accessory configured for outdoor sporting games. (A63B71/02)

SUMMARY OF INVENTION

The football training device is a physical training apparatus. The football training device is configured for use with the sport of American football. The football training device trains an individual in the motions associated with a swim move. The football training device further trains an individual in the motions associated with a rip move. The football training device comprises a stand and a training structure. The training structure attaches to the stand. The training structure further comprises a plurality of cants. The plurality of cants form a series of spatial relationships between the components of the training structure. The plurality of cants emulate the position and motion of an opponent during training activities.

These together with additional objects, features and advantages of the football training device will be readily apparent to those of ordinary skill in the art upon reading the following detailed description of the presently preferred, but nonetheless illustrative, embodiments when taken in conjunction with the accompanying drawings.

In this respect, before explaining the current embodiments of the football training device in detail, it is to be understood that the football training device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the football training device.

It is therefore important that the claims be regarded as including such equivalent construction insofar as they do not depart from the spirit and scope of the football training device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
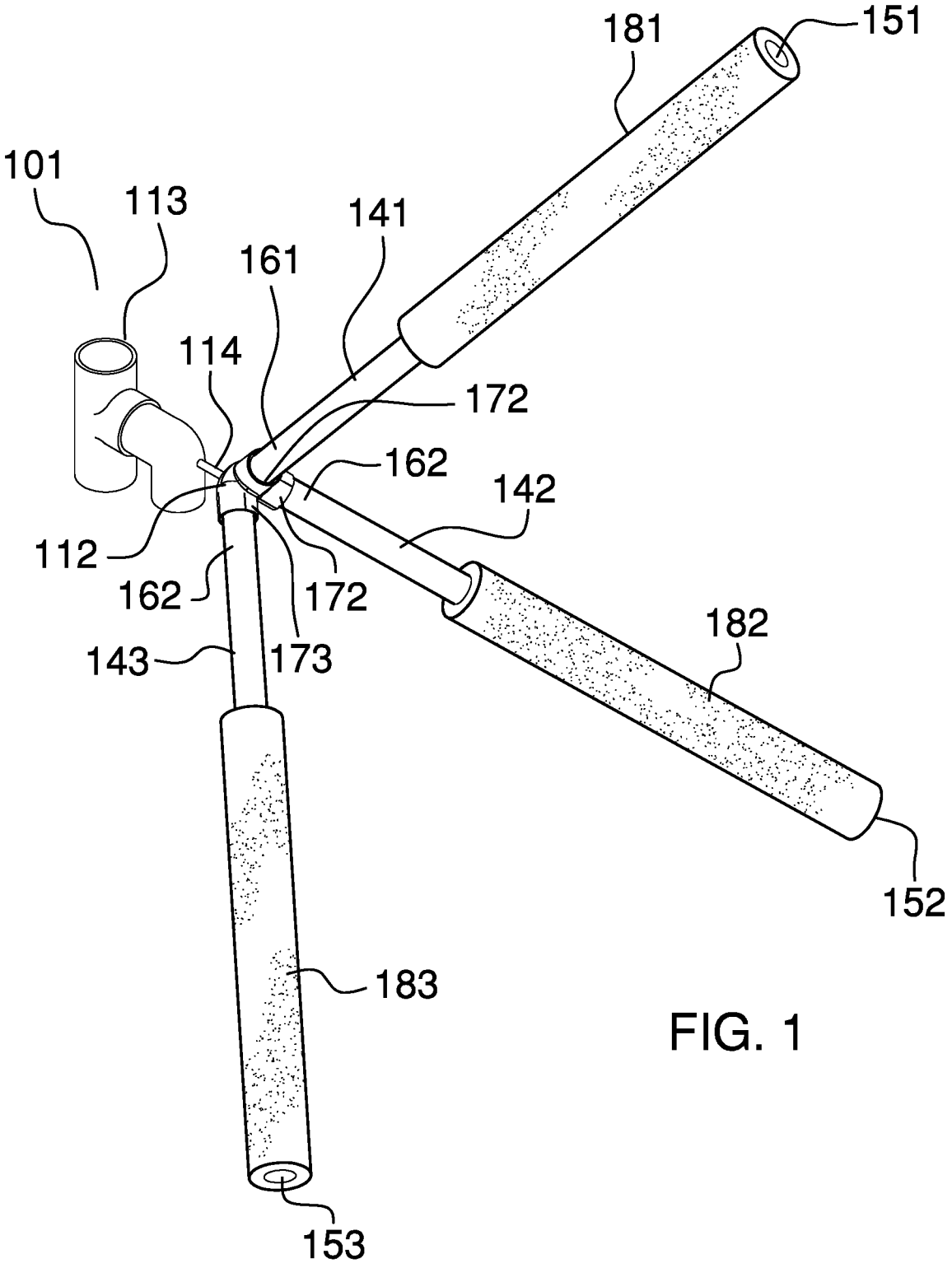
FIG. 1 is a perspective view of an embodiment of the disclosure.
Figure 2:
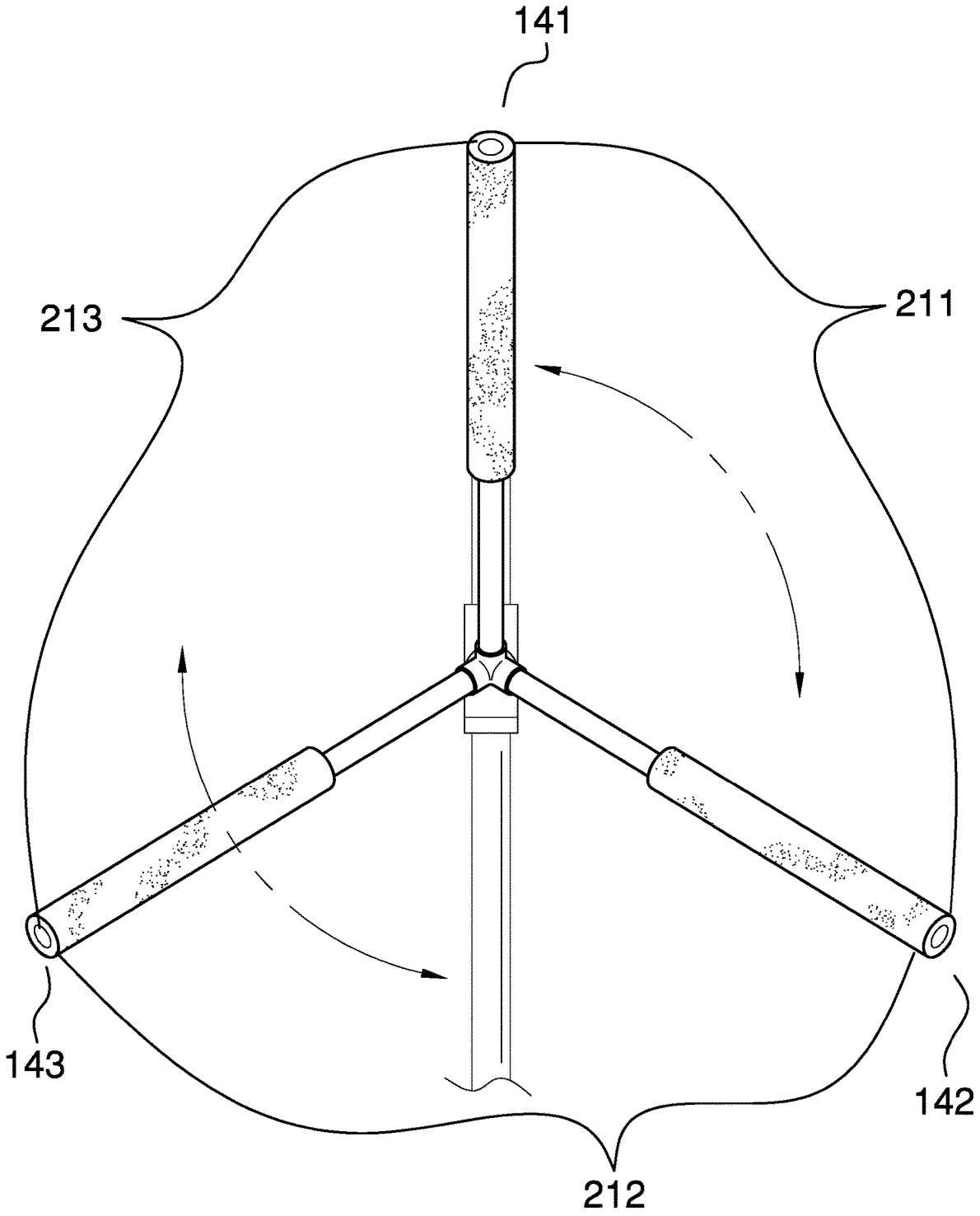
FIG. 2 is a front view of an embodiment of the disclosure.
Figure 3:
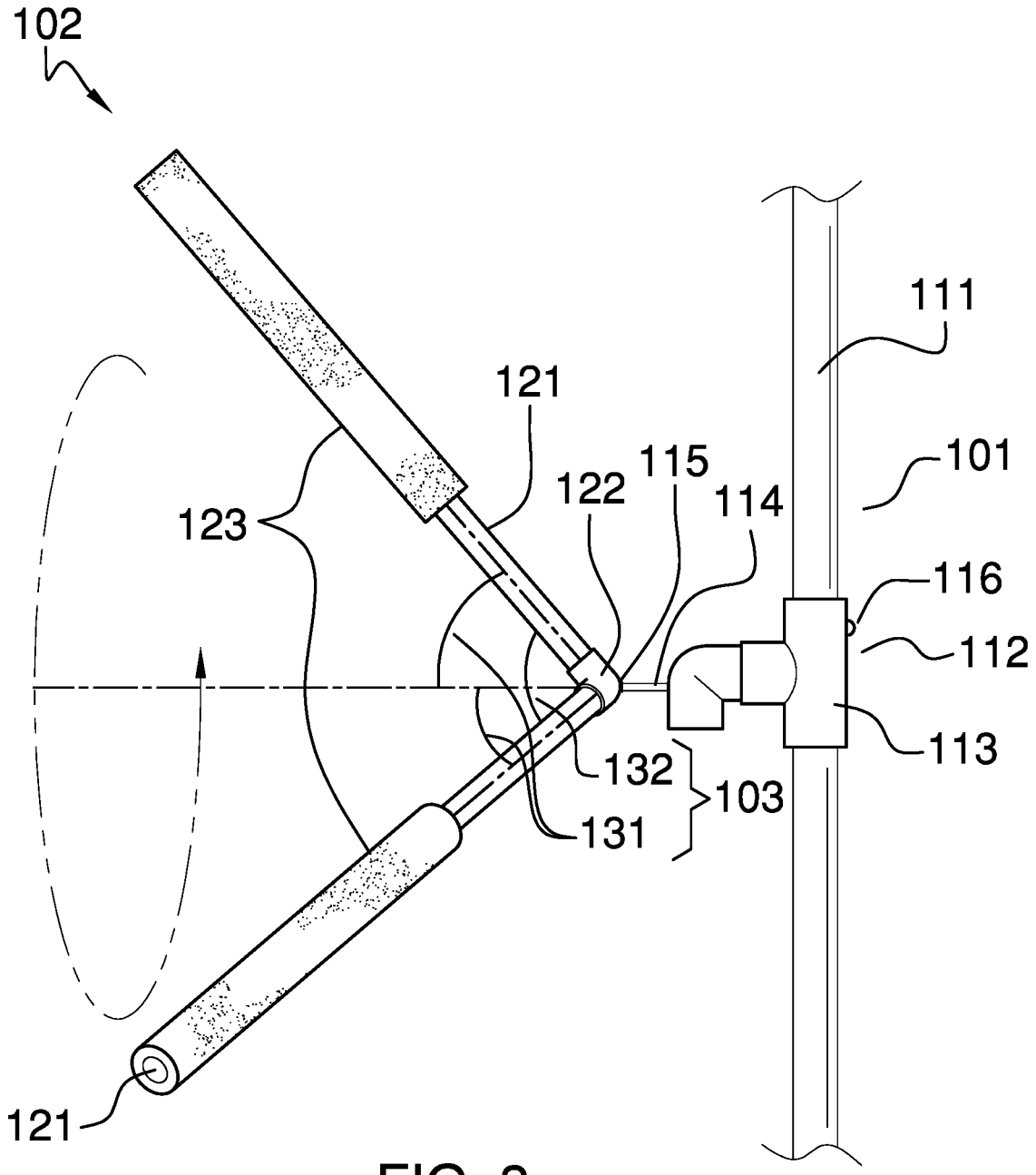
FIG. 3 is a side view of an embodiment of the disclosure.
Figure 4:
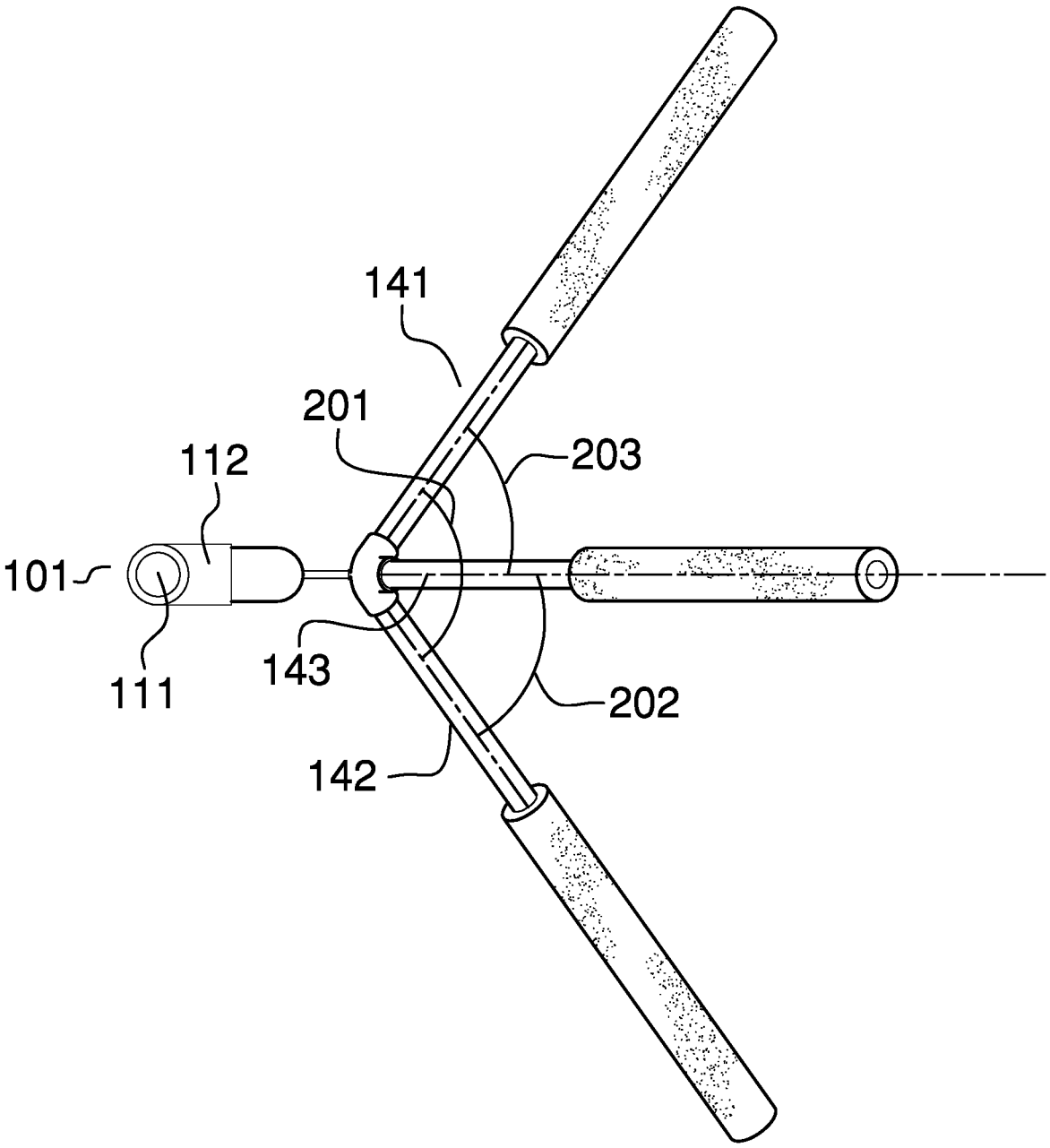
FIG. 4 is a top view of an embodiment of the disclosure.
Figure 5:
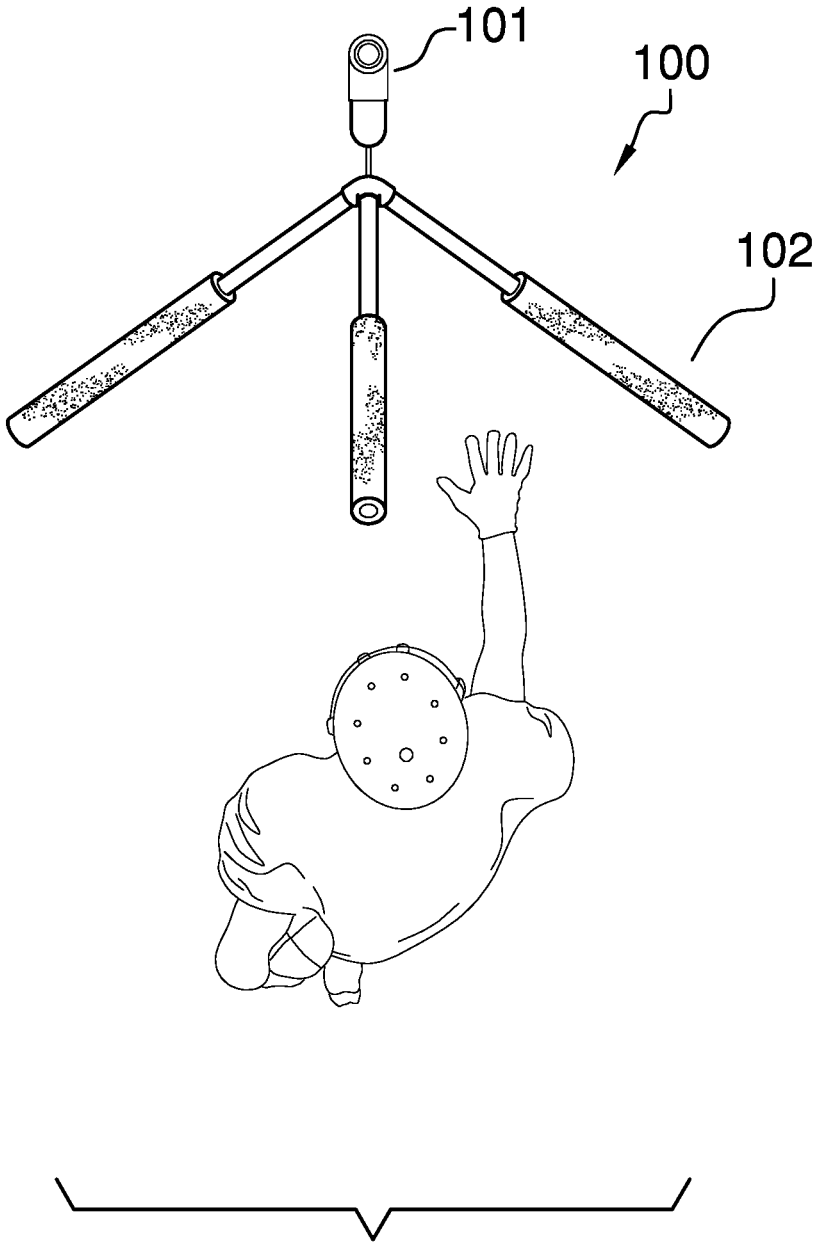
FIG. 5 is an in-use view of an embodiment of the disclosure.

Detailed reference will now be made to one or more potential embodiments of the disclosure, which are illustrated in FIGS. 1 through 5.

The football training device 100 (hereinafter invention) is a physical training apparatus. The invention 100 is configured for use with the sport of American football. The invention 100 trains an individual in the motions associated with a swim move. The invention 100 further trains an individual in the motions associated with a rip move. The invention 100 comprises a stand 101 and a training structure 102. The training structure 102 attaches to the stand 101. The training structure 102 further comprises a plurality of cants 103. The plurality of cants 103 form a series of spatial relationships between the components of the training structure 102. The plurality of cants 103 emulate the position and motion of an opponent during training activities.

The stand 101 is a mechanical structure. The stand 101 elevates the training structure 102 above a supporting surface. The stand 101 forms a load path that transfers the load of the training structure 102 to the supporting surface. The elevation of the training structure 102 is adjustable. The stand 101 comprises a stanchion 111 and a clamp 112.

The stanchion 111 is a prism-shaped structure. The stanchion 111 is a rigid structure. The stanchion 111 anchors to the supporting surface. The center axis of the prism structure of the stanchion 111 is vertically oriented. The stanchion 111 forms a load path that transfers the load of the training structure 102 to the supporting surface.

The clamp 112 is a prism-shaped structure. The clamp 112 is a rigid structure. The clamp 112 is a hollow tubular structure. The clamp 112 is geometrically similar to the stanchion 111. The span of the length of the inner diameter of the clamp 112 is greater than the span of the length of the outer diameter of the stanchion 111 such that the stanchion 111 inserts into and through the clamp 112. The clamp 112 secures the training structure 102 to the stanchion 111. The clamp 112 attaches the training structure 102 to the stanchion 111 such that the elevation of the clamp 112 above the supporting surface is adjustable. The clamp 112 comprises a sleeve 113, a mounting jib 114, a mounting pivot 115, and a detent 116.

The sleeve 113 is a prism-shaped structure. The sleeve 113 is a rigid structure. The sleeve 113 is a hollow tubular structure. The sleeve 113 is geometrically similar to the stanchion 111. The span of the length of the inner diameter of the sleeve 113 is greater than the span of the length of the outer diameter of the stanchion 111 such that the stanchion 111 inserts into and through the sleeve 113.

The mounting jib 114 is a prism-shaped structure. The mounting jib 114 is a rigid structure. The mounting jib 114 attaches to the exterior lateral face of the prism structure of the sleeve 113. The center axis of the prism structure of the mounting jib 114 projects radially away from the lateral face of the prism structure of the sleeve 113. The mounting jib 114 attaches to the sleeve 113 in the manner of a cantilever. The training structure 102 attaches to the free end of the cantilever structure of the mounting jib 114. The mounting jib 114 forms an extension structure that extends the reach between the training structure 102 and the stanchion 111.

The mounting pivot 115 is a bearing structure. In the first potential embodiment of the disclosure, the mounting pivot 115 is a rolling element bearing. The mounting pivot 115 attaches the training structure 102 to the mounting jib 114 such that the training structure 102 rotates relative to the stand 101. The mounting pivot 115 attaches the training structure 102 to the mounting jib 114 such that the axis of rotation of the training structure 102 aligns with the center axis of the prism structure of the mounting jib 114.

The detent 116 is a mechanical structure. The detent 116 is defined elsewhere in this disclosure. The detent 116 mechanically secures the sleeve 113 into a fixed position at a given elevation above the supporting surface.

The training structure 102 is a mechanical structure. The training structure 102 is a rotating structure. The rotation of the training structure 102 emulates the motion of the opposing player. The rotation of the training structure 102 allows an individual to practice a swim move during training activities. The training structure 102 comprises a plurality of training arms 121, an elbow 122, and a plurality of cushions 123.

Each of the plurality of training arms 121 is a prism-shaped structure. Each of the plurality of training arms 121 is a rigid structure. Each of the plurality of training arms 121 is identical. The plurality of training arms 121 comprises a first training arm 141, a second training arm 142, and a third training arm 143.

The first training arm 141 is a prism-shaped rigid structure. The first training arm 141 attaches to the elbow 122 in the manner of a cantilever. The rotation of the elbow 122 moves the first training arm 141 during training activities. The first training arm 141 further comprises a first free end 151 and a first fixed end 161. The first free end 151 is the congruent end of the prism structure of the first training arm 141 that is distal from the elbow 122. The first fixed end 161 is the congruent end of the prism structure of the first training arm 141 that attaches to the elbow 122.

The second training arm 142 is a prism-shaped rigid structure. The second training arm 142 attaches to the elbow 122 in the manner of a cantilever. The rotation of the elbow 122 moves the second training arm 142 during training activities. The second training arm 142 further comprises a second free end 152 and a second fixed end 162. The second free end 152 is the congruent end of the prism structure of the second training arm 142 that is distal from the elbow 122. The second fixed end 162 is the congruent end of the prism structure of the second training arm 142 that attaches to the elbow 122.

The third training arm 143 is a prism-shaped rigid structure. The third training arm 143 attaches to the elbow 122 in the manner of a cantilever. The rotation of the elbow 122 moves the third training arm 143 during training activities. The third training arm 143 further comprises a third free end 153 and a third fixed end 163. The third free end 153 is the congruent end of the prism structure of the third training arm 143 that is distal from the elbow 122. The third fixed end 163 is the congruent end of the prism structure of the third training arm 143 that attaches to the elbow 122.

The elbow 122 is a fitting. Each training arm selected from the plurality of training arms 121 attaches to the elbow 122. The elbow 122 attaches the plurality of training arms 121 to the free end of the mounting jib 114 of the stand 101. The elbow 122 attaches to the mounting jib 114 using the mounting pivot 115 such that the elbow 122 rotates relative to the mounting jib 114. The elbow 122 comprises a first port 171, a second port 172, and a third port 173.

The first port 171 is a port formed in the elbow 122. The first port 171 is a negative space. The first port 171 is geometrically similar to the first training arm 141. The first port 171 attaches the first training arm 141 to the elbow 122. The span of the length of the inner diameter of the prism structure of the first port 171 is greater than the span of the length of the outer diameter of the prism structure of the first training arm 141 such that the first fixed end 161 of the first training arm 141 inserts into the first port 171.

The second port 172 is a port formed in the elbow 122. The second port 172 is a negative space. The second port 172 is geometrically similar to the second training arm 142. The second port 172 attaches the second training arm 142 to the elbow 122. The span of the length of the inner diameter of the prism structure of the second port 172 is greater than the span of the length of the outer diameter of the prism structure of the second training arm 142 such that the second fixed end 162 of the second training arm 142 inserts into the second port 172.

The third port 173 is a port formed in the elbow 122. The third port 173 is a negative space. The third port 173 is geometrically similar to the third training arm 143. The third port 173 attaches the third training arm 143 to the elbow 122. The span of the length of the inner diameter of the prism structure of the third port 173 is greater than the span of the length of the outer diameter of the prism structure of the third training arm 143 such that the third fixed end 163 of the third training arm 143 inserts into the third port 173.

Each of the plurality of cushions 123 is a prism-shaped structure. Each of the plurality of cushions 123 is a padded structure. Each of the plurality of cushions 123 has a capped tube structure. Each of the plurality of cushions 123 is identical. The span of the length of the inner diameter of each of the plurality of cushions 123 is greater than the span of the length of the outer diameter of each of the plurality of training arms 121 such that any training arm selected from the plurality of training arms 121 inserts into any cushion selected from the plurality of cushions 123. In the first potential embodiment of the disclosure, each of the plurality of cushions 123 is formed from a polyurethane foam. The plurality of cushions 123 comprises a first cushion 181, a second cushion 182, and a third cushion 183.

The first cushion 181 is a prism-shaped structure. The first cushion 181 is an elastomeric structure. The first cushion 181 has a capped tube structure. The first free end 151 of the first training arm 141 inserts into the first cushion 181. The span of the length of the inner diameter of the prism structure of the first cushion 181 is lesser than the span of the length of the outer diameter of the prism structure of the first training arm 141 such that the return of the elastomeric structure of the first cushion 181 to its relaxed shape applies a pressure against the lateral face of the prism structure of the first training arm 141 that secures the first cushion 181 to the first training arm 141. The first cushion 181 forms a cushioning structure that prevents injury during the use of the invention 100.

The second cushion 182 is a prism-shaped structure. The second cushion 182 is an elastomeric structure. The second cushion 182 has a capped tube structure. The second free end 152 of the second training arm 142 inserts into the second cushion 182. The span of the length of the inner diameter of the prism structure of the second cushion 182 is lesser than the span of the length of the outer diameter of the prism structure of the second training arm 142 such that the return of the elastomeric structure of the second cushion 182 to its relaxed shape applies a pressure against the lateral face of the prism structure of the second training arm 142 that secures the second cushion 182 to the second training arm 142. The second cushion 182 forms a cushioning structure that prevents injury during the use of the invention 100.

The third cushion 183 is a prism-shaped structure. The third cushion 183 is an elastomeric structure. The third cushion 183 has a capped tube structure. The third free end 153 of the third training arm 143 inserts into the third cushion 183. The span of the length of the inner diameter of the prism structure of the third cushion 183 is lesser than the span of the length of the outer diameter of the prism structure of the third training arm 143 such that the return of the elastomeric structure of the third cushion 183 to its relaxed shape applies a pressure against the lateral face of the prism structure of the third training arm 143 that secures the third cushion 183 to the third training arm 143. The third cushion 183 forms a cushioning structure that prevents injury during the use of the invention 100.

The rotation of the plurality of cants 103 allows an individual to practice a rip move during training activities. Each of the plurality of cants 103 is a cant that is formed between an element of the training structure 102 and a portion of the stand 101. Each of the plurality of cants 103 are selected such that the rotation of the training structure 102 emulates the motions of an opponent. The plurality of cants 103 comprises a plurality of cantilever cants 131 and a plurality of stanchion 111 cants 132.

Each of the plurality of cantilever cants 131 is a cant that is formed between the center axis of the prism structure of a training arm selected from the plurality of training arms 121 and the center axis of the prism structure of the mounting jib 114 of the clamp 112 of the stand 101. The angle of the cant formed by each of the plurality of cantilever cants 131 is greater than 20 degrees. The angle of the cant formed by each of the plurality of cantilever cants 131 is lesser than 28 degrees. The applicant prefers that the angle of the cant formed by each of the plurality of cantilever cants 131 equals 24 degrees. The plurality of cantilever cants 131 comprises a first cantilever cant 201, a second cantilever cant 202, and a third cantilever cant 203.

The first cantilever cant 201 is the measure of the angle formed between the center axis of the prism structure of the first training arm 141 and the center axis of the prism structure of the mounting jib 114 of the clamp 112 of the stand 101. The second cantilever cant 202 is the measure of the angle formed between the center axis of the prism structure of the second training arm 142 and the center axis of the prism structure of the mounting jib 114 of the clamp 112 of the stand 101. The third cantilever cant 203 is the measure of the angle formed between the center axis of the prism structure of the third training arm 143 and the center axis of the prism structure of the mounting jib 114 of the clamp 112 of the stand 101. The span of the arc of the second cantilever cant 202 equals the span of the arc of the first cantilever cant 201. The span of the arc of the third cantilever cant 203 equals the span of the arc of the second cantilever cant 202.

Each of the plurality of stanchion 111 cants 132 is a cant that is formed between the center axis of the prism structure of any training arm initially selected from the plurality of training arms 121 and the center axis of the prism structure of any training arm subsequently selected from the plurality of training arms 121. The angle of the cant formed by each of the plurality of stanchion 111 cants 132 is identical. The plurality of stanchion 111 cants 132 comprises a first stanchion 111 cant 211, a second stanchion 111 cant 212, and a third stanchion 111 cant 213.

The first stanchion 111 cant 211 is the measure of the angle formed between the center axis of the prism structure of the first training arm 141 and the center axis of the prism structure of the second training arm 142. The second stanchion 111 cant 212 is the measure of the angle formed between the center axis of the prism structure of the second training arm 142 and the center axis of the prism structure of the third training arm 143. The third stanchion 111 cant 213 is the measure of the angle formed between the center axis of the prism structure of the third training arm 143 and the center axis of the prism structure of the first training arm 141. The span of the arc of the first cantilever cant 201 equals the span of the arc of the second cantilever cant 202. The span of the arc of the second cantilever cant 202 equals the span of the arc of the third cantilever cant 203. The span of the arc of the third cantilever cant 203 equals the span of the arc of the first cantilever cant 201.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Angle: As used in this disclosure, an angle is a measure of a region between two intersecting lines or surfaces.

Bearing: As used in this disclosure, a bearing is a mechanical device that: 1) guides and limits the motion of a moving component relative to a fixed component; and, 2) reduces the friction between the moving component and the fixed component. The use of bearings is well known and documented in the mechanical arts.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Capped Tube: As used in this disclosure, a capped tube is a tube with one closed end and one open end.

Carbamate: As used in this disclosure, a carbamate is a functional group consisting of an O—(C═O)—N structure. Carbamate is informally referred to as urethane.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Cushion: As used in this disclosure, a cushion is a structure formed from a pad that is used to prevent injury or damage to a person or object.

Detent: As used in this disclosure, a detent is a device for positioning and holding a first object relative to a second object such that the position of the first object relative to the second object is adjustable.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter. Include Radial Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Relaxed Shape: As used in this disclosure, a structure is considered to be in its relaxed state when no shear, strain, or torsional forces are being applied to the structure.

Elbow: As used in this disclosure, an elbow is a fitting that interconnects a plurality of pipes such that the center axis of at least one pipe attached to the elbow intersects at a point with the center axis of each of the remaining pipes contained in the plurality of pipes.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Structure: As used in this disclosure, an extension structure is an inert physical structure that is used to extend or bridge the reach between any two objects.

Fitting: As used in this disclosure, a fitting is a component that attaches a first object to a one or more additional objects. The fitting is often used to forming a fluidic connection between the first object and the one or more additional objects.

Fixed End: As used in this disclosure, a fixed end refers to the end of a shaft, pipe, or tube that attaches to an object.

Foam: As used in this disclosure, foam is a mass of gas filled spaces, commonly referred to as bubbles, which can be formed: 1) on or in a liquid or gel; or, 2) in a solid material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Free End: As used in this disclosure, a free end refers to the end of a shaft, pipe, or tube that is not attached to an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Monomer: As used in this disclosure, a monomer refers to a molecular structure that bonds to itself in a repeating manner to form a polymer.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Perimeter: As used in this disclosure, a perimeter is one or more curved or straight lines that bounds an enclosed area on a plane or surface. The perimeter of a circle is commonly referred to as a circumference.

Pipe: As used in this disclosure, the term pipe is used to describe a rigid hollow cylinder. While pipes that are suitable for use in this disclosure are often used to transport or conveys fluids or gases, the purpose of the pipes in this disclosure are structural. In this disclosure, the terms inner diameter of a pipe and outer diameter are used as they would be used by those skilled in the plumbing arts.

Pivot: As used in this disclosure, a pivot is a rod or shaft around which an object rotates or swings.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Port: As used in this disclosure, a port is an opening formed in a first object that allows a second object to pass through a boundary formed by the first object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force. See bimodal flexible structure.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk shaped. A rolling element bearing is said to be "locking" when the relative position of the inner race in be locked into a fixed position relative to the outer race. Rolling element bearings, including locking versions, are: 1) commercially available; and, 2) well-known and documented in the mechanical arts.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object. See Foundation Tube: As used in this disclosure, the term tube is used to describe a rigid hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A football training device comprising
a stand and a training structure;
wherein the training structure attaches to the stand;
wherein the football training device is a physical training apparatus;
wherein the training structure further comprises a plurality of cants;
wherein the plurality of cants form a series of spatial relationships between components of the training structure;
wherein the stand comprises a stanchion and a clamp;
wherein the clamp attaches the training structure to the stanchion such that the elevation of the clamp above the supporting surface is adjustable;
wherein the clamp comprises a sleeve, a mounting jib, a mounting pivot, and a detent;
wherein the mounting jib attaches to the sleeve;
wherein the mounting pivot attaches the training structure to the mounting jib;
wherein the detent mechanically secures the sleeve into a fixed position at a given elevation above the supporting surface;
wherein the sleeve is a rigid structure;
wherein the sleeve is a hollow tubular structure;
wherein the sleeve is geometrically similar to the stanchion;
wherein the span of the length of the inner diameter of the sleeve is greater than the span of the length of the outer diameter of the stanchion such that the stanchion inserts into and through the sleeve.

2. The football training device according to claim 1
wherein the stand is a mechanical structure;
wherein the stand elevates the training structure above a supporting surface;
wherein the stand forms a load path that transfers the load of the training structure to the supporting surface;
wherein the elevation of the training structure is adjustable.

3. The football training device according to claim 2
wherein the training structure is a mechanical structure;
wherein the training structure is a rotating structure;
wherein the rotation of the training structure emulates the motion of the opposing player;
wherein the rotation of the training structure allows an individual to practice a swim move during training activities.

4. The football training device according to claim 3
wherein each of the plurality of cants is a cant that is formed between an element of the training structure and a portion of the stand;
wherein each of the plurality of cants are selected such that the rotation of the training structure emulates the motions of an opponent.

5. The football training device according to claim 4
wherein the training structure comprises a plurality of training arms, an elbow, and a plurality of cushions;
wherein each of the plurality of training arms attach to the elbow;
wherein each cushion selected from the plurality of cushions attaches to a training arm selected from the plurality of training arms.

6. The football training device according to claim 5
wherein the plurality of cants comprises a plurality of cantilever cants and a plurality of stanchion cants;
wherein each of the plurality of cantilever cants is a cant that is formed between the center axis of a training arm selected from the plurality of training arms and the center axis of the mounting jib of the clamp of the stand;
wherein each of the plurality of stanchion cants is a cant that is formed between the center axis of any training arm initially selected from the plurality of training arms and the center axis of any training arm subsequently selected from the plurality of training arms;
wherein the angle of the cant formed by each of the plurality of cantilever cants is between 20 degrees and 28 degrees;
wherein the angle of the cant formed by each of the plurality of stanchion cants is identical.

7. The football training device according to claim 6
wherein the stanchion is a rigid structure;
wherein the stanchion anchors to the supporting surface;
wherein the center axis of the stanchion is vertically oriented;

wherein the stanchion forms a load path that transfers the load of the training structure to the supporting surface.

8. The football training device according to claim 7 wherein the clamp is a rigid structure;

wherein the clamp is a hollow tubular structure;

wherein the clamp is geometrically similar to the stanchion;

wherein the span of the length of the inner diameter of the clamp is greater than the span of the length of the outer diameter of the stanchion such that the stanchion inserts into and through the clamp.

9. The football training device according to claim 8 wherein the mounting jib is a rigid structure;

wherein the mounting jib attaches to the exterior lateral face of the sleeve;

wherein the center axis of the mounting jib projects radially away from the lateral face of the sleeve;

wherein the mounting jib attaches to the sleeve in the manner of a cantilever structure;

wherein the training structure attaches to the free end of the cantilever structure of the mounting jib;

wherein the mounting jib forms an extension structure that extends the reach between the training structure and the stanchion.

10. The football training device according to claim 9 wherein the mounting pivot is a bearing structure;

wherein the mounting pivot is a rolling element bearing;

wherein the mounting pivot attaches the training structure to the mounting jib such that the training structure rotates relative to the stand;

wherein the mounting pivot attaches the training structure to the mounting jib such that the axis of rotation of the training structure aligns with the center axis of the mounting jib.

11. The football training device according to claim 10 wherein each of the plurality of training arms is a rigid structure;

wherein each of the plurality of training arms is identical;

wherein the elbow is a fitting;

wherein each training arm selected from the plurality of training arms attaches to the elbow;

wherein the elbow attaches the plurality of training arms to the free end of the mounting jib of the stand;

wherein the elbow attaches to the mounting jib using the mounting pivot such that the elbow rotates relative to the mounting jib.

12. The football training device according to claim 11 wherein each of the plurality of cushions is a padded structure;

wherein each of the plurality of cushions has a capped tube structure;

wherein each of the plurality of cushions is identical;

wherein the span of the length of the inner diameter of each of the plurality of cushions is greater than the span of the length of the outer diameter of each of the plurality of training arms such that any training arm selected from the plurality of training arms inserts into any cushion selected from the plurality of cushions.

13. The football training device according to claim 12 wherein the plurality of training arms comprises a first training arm, a second training arm, and a third training arm;

wherein the first training arm attaches to the elbow in the manner of a cantilever;

wherein the rotation of the elbow moves the first training arm during training activities;

wherein the first training arm further comprises a first free end and a first fixed end;

wherein the first free end is the congruent end of the first training arm that is distal from the elbow;

wherein the first fixed end is the congruent end of the first training arm that attaches to the elbow;

wherein the second training arm attaches to the elbow in the manner of a cantilever;

wherein the rotation of the elbow moves the second training arm during training activities;

wherein the second training arm further comprises a second free end and a second fixed end;

wherein the second free end is the congruent end of the second training arm that is distal from the elbow;

wherein the second fixed end is the congruent end of the second training arm that attaches to the elbow;

wherein the third training arm attaches to the elbow in the manner of a cantilever;

wherein the rotation of the elbow moves the third training arm during training activities;

wherein the third training arm further comprises a third free end and a third fixed end;

wherein the third free end is the congruent end of the third training arm that is distal from the elbow;

wherein the third fixed end is the congruent end of the third training arm that attaches to the elbow.

14. The football training device according to claim 13 wherein the elbow comprises a first port, a second port, and a third port;

wherein the first port is a port formed in the elbow;

wherein the first port is a negative space;

wherein the first port is geometrically similar to the first training arm;

wherein the first port attaches the first training arm to the elbow;

wherein the span of the length of the inner diameter of the first port is greater than the span of the length of the outer diameter of the first training arm such that the first fixed end of the first training arm inserts into the first port;

wherein the second port is a port formed in the elbow;

wherein the second port is a negative space;

wherein the second port is geometrically similar to the second training arm;

wherein the second port attaches the second training arm to the elbow;

wherein the span of the length of the inner diameter of the second port is greater than the span of the length of the outer diameter of the second training arm such that the second fixed end of the second training arm inserts into the second port;

wherein the third port is a port formed in the elbow;

wherein the third port is a negative space;

wherein the third port is geometrically similar to the third training arm;

wherein the third port attaches the third training arm to the elbow;

wherein the span of the length of the inner diameter of the third port is greater than the span of the length of the outer diameter of the third training arm such that the third fixed end of the third training arm inserts into the third port.

15. The football training device according to claim 14 wherein the plurality of cushions comprises a first cushion, a second cushion, and a third cushion;

wherein the first cushion is an elastomeric structure;

wherein the first cushion has a capped tube structure;

wherein the first free end of the first training arm inserts into the first cushion;

wherein the span of the length of the inner diameter of the first cushion is lesser than the span of the length of the outer diameter of the first training arm such that the return of the elastomeric structure of the first cushion to a relaxed shape applies a pressure against the lateral face of the first training arm that secures the first cushion to the first training arm;

wherein the first cushion forms a cushioning structure that prevents injury during the use of the football training device;

wherein the second cushion is an elastomeric structure;

wherein the second cushion has a capped tube structure;

wherein the second free end of the second training arm inserts into the second cushion;

wherein the span of the length of the inner diameter of the second cushion is lesser than the span of the length of the outer diameter of the second training arm such that the return of the elastomeric structure of the second cushion to its relaxed shape applies a pressure against the lateral face of the second training arm that secures the second cushion to the second training arm;

wherein the second cushion forms a cushioning structure that prevents injury during the use of the football training device;

wherein the third cushion is an elastomeric structure;

wherein the third cushion has a capped tube structure;

wherein the third free end of the third training arm inserts into the third cushion;

wherein the span of the length of the inner diameter of the third cushion is lesser than the span of the length of the outer diameter of the third training arm such that the return of the elastomeric structure of the third cushion to its relaxed shape applies a pressure against the lateral face of the third training arm that secures the third cushion to the third training arm;

wherein the third cushion forms a cushioning structure that prevents injury during the use of the football training device.

16. The football training device according to claim 15 wherein the plurality of cantilever cants comprises a first cantilever cant, a second cantilever cant, and a third cantilever cant;

wherein the first cantilever cant is the measure of the angle formed between the center axis of the first training arm and the center axis of the mounting jib of the clamp of the stand;

wherein the second cantilever cant is the measure of the angle formed between the center axis of the second training arm and the center axis of the mounting jib of the clamp of the stand;

wherein the third cantilever cant is the measure of the angle formed between the center axis of the third training arm and the center axis of the mounting jib of the clamp of the stand;

wherein the span of the arc of the second cantilever cant equals the span of the arc of the first cantilever cant;

wherein the span of the arc of the third cantilever cant equals the span of the arc of the second cantilever cant.

17. The football training device according to claim 16 wherein the plurality of stanchion cants comprises a first stanchion cant, a second stanchion cant, and a third stanchion cant;

wherein the first stanchion cant is the measure of the angle formed between the center axis of the first training arm and the center axis of the second training arm;

wherein the second stanchion cant is the measure of the angle formed between the center axis of the second training arm and the center axis of the third training arm;

wherein the third stanchion cant is the measure of the angle formed between the center axis of the third training arm and the center axis of the first training arm;

wherein the span of the arc of the first cantilever cant equals the span of the arc of the second cantilever cant;

wherein the span of the arc of the second cantilever cant equals the span of the arc of the third cantilever cant;

wherein the span of the arc of the third cantilever cant equals the span of the arc of the first cantilever cant.

* * * * *